United States Patent [19]

Agdern

[11] 4,398,846

[45] Aug. 16, 1983

[54] SUBSEA RISER MANIFOLD WITH STRUCTURAL SPANNING MEMBER FOR SUPPORTING PRODUCTION RISER

[75] Inventor: Fredric A. Agdern, Dallas, Tex.

[73] Assignee: Mobil Oil Corporation, New York, N.Y.

[21] Appl. No.: 246,526

[22] Filed: Mar. 23, 1981

[51] Int. Cl.[3] ..... B63C 11/00; E02D 21/00; E21B 33/035; E21B 33/038

[52] U.S. Cl. ..... 405/185; 405/195; 166/345; 166/366

[58] Field of Search ..... 405/195, 207, 224, 227, 405/185; 166/96, 341, 345, 359, 366

[56] References Cited

U.S. PATENT DOCUMENTS

| | | | |
|---|---|---|---|
| Re. 27,745 | 8/1973 | Brooks et al. . | |
| 3,366,173 | 1/1968 | McIntosh . | |
| 3,524,322 | 8/1970 | Pogonowski | 405/227 |
| 3,662,559 | 5/1972 | Swift . | |
| 3,765,463 | 10/1973 | Gassett et al. | 405/227 X |
| 3,877,520 | 4/1975 | Putnam . | |
| 4,039,025 | 8/1977 | Burkhardt et al. | 405/227 X |
| 4,098,333 | 7/1978 | Wells et al. . | |
| 4,167,215 | 9/1979 | Thorne | 166/341 |
| 4,182,584 | 1/1980 | Panicker et al. . | |
| 4,194,568 | 3/1980 | Buresi et al. . | |
| 4,211,281 | 7/1980 | Lawson . | |
| 4,215,544 | 8/1980 | Stanwick . | |
| 4,234,047 | 11/1980 | Mott . | |

*Primary Examiner*—James A. Leppink
*Assistant Examiner*—Nancy J. Pistel
*Attorney, Agent, or Firm*—C. A. Huggett; M. G. Gilman; J. F. Powers, Jr.

[57] ABSTRACT

A subsea riser mainfold system is disclosed for handling marine well fluids from multiple subsea wells and transmitting the well fluids through a marine production riser. The system includes a marine floor base template having a support structure and a manifold chamber supported thereon. Pile guides are connected to the template for fixing the template to the marine floor. The sealed manifold chamber hull is mounted on the template between the pile guides, enclosing manifold means for operatively connecting the subsea wells to the production riser. An improved structural spanning support member extends over the manifold chamber hull for receiving and supporting the marine production riser. This spanning member has an upper riser-receiving platform portion and structural spider arms connected between the platform production and the pile guides through the spanning member.

5 Claims, 9 Drawing Figures

SUBSEA RISER MANIFOLD WITH STRUCTURAL SPANNING MEMBER FOR SUPPORTING PRODUCTION RISER

BACKGROUND OF THE INVENTION

This invention relates to a subsea riser manifold system for handling oil and/or gas production from offshore wells. In particular, it provides a structure for supporting a subsea riser on a marine floor base.

This invention relates to the production of hydrocarbon fluids from subaqueous formations utilizing a system of submerged wellheads and a product gathering network. Recent developments in the offshore oil and gas industry extend production to undersea areas, such as the outer fringes of the continental shelves and the continental slopes. A submarine production system is believed to be the most practical method of reaching the subaqueous deposits. Although hydrocarbons are the main concern at this time, it is contemplated that subaqueous deposits of sulfur and other minerals can be produced from beneath the seas. While bottom-supported permanent surface installations have proved to be economically and technologically feasible in comparatively shallow waters, in deeper waters, such as several hundred to several thousand meters, utilization of such surface installations must be limited to very special situations. Installations extending above the water surface are also disadvantageous even in shallower water where there are adverse surface conditions, as in areas where the bottom-supported structure of above-surface production platforms are subject to ice loading.

Subsea production and gathering systems are feasible for installing wellheads or well clusters at multiple locations on a marine floor area. Flowlines for production fluids, injection fluids, hydraulic controls, etc. can be laid on the marine floor from remote locations to a central point for connection to a production riser, which connects a manifold system to a surface facility for processing. Habitable satellites can be maintained adjacent the wellhead or manifold structures for operating and maintenance personnel, as disclosed in U.S. Pat. No. 3,520,358 (Brooks et al). One such satellite may be a subsea atmospheric riser manifold (SARM), which contains a fluid handling system for operatively connecting a plurality of flowlines to a production riser. Such a manned system could have a central hull chamber enclosing the manifold piping, valves, etc. and a control room for sustaining life in the extreme environmental conditions of deepwater. In order to enclose a multi-well manifold system, such a manifold chamber would be necessarily large and would require great vessel integrity to withstand the deepwater hydrostatic pressure, equivalent to many atmospheres exterior pressure. The SARM system should be capable of supporting human life over long periods, which requires internal pressures at or near atmospheric.

Riser manifold systems have not been successful in large production gathering networks due to the extreme conditions for connecting a heavy duty production riser with a large multi-well subsea manifold system. Recent advances in production riser design (e.g. U.S. Pat. No. 4,182,584, incorporated by reference) provide a relatively fixed lower riser section, buoyed at a submerged location to avoid ocean turbulence and a compliant section connected to a production vessel. Considerable force must be withstood at the point of connecting the buoyed riser at the marine base. Considering the many tons of vertical force and deflection of the riser due to ocean currents, a direct load-bearing mechanical connection between the production riser section and manifold chamber has been impractical.

It is an object of the present invention to provide a reliable subsea riser manifold system capable of handling multi-well fluids and withstanding the rigors of a large riser connection. According to the present invention, subsea riser manifold system is provided for handling marine well fluids from multiple subsea wells and transmitting the well fluids through a marine production riser.

A marine floor base template having a support structure is adapted to support a manifold chamber. A plurality of pile guides are connected to the template for fixing the template to the marine floor, and a sealed manifold chamber hull is mounted on the template between the pile guides. This chamber hull encloses manifold means for operatively connecting the subsea wells to the production riser. The improved manifold system includes a structural spanning support member extending over the manifold chamber hull for receiving and supporting the marine production riser. This spanning member has an upper riser-receiving platform portion and structural arms connected between the platform portion and the pile guides, whereby production riser load is transmitted directly to the pile guides through the spanning member.

The preferred manifold chamber hull comprises a fluid-tight horizontal cylindrical pressure vessel and means for maintaining a low pressure atmosphere therein. Advantageously, the manifold spanning member has a pair of spanning arms on opposite sides of the manifold chamber, each arm extending outwardly and downwardly from the platform portion in a spider configuration, connecting the riser in load-bearing relationship to the pile supports. Ordinarily the platform portion is vertically spaced from the manifold chamber hull and has at least one access opening to permit connection of production riser conduit through the manifold chamber.

These and other advantages and features will be understood from the following description and in the drawing.

THE DRAWING

FIG. 2A is a side elevation view thereof, with the flowline bundles partially removed for clarity.

DESCRIPTION OF PREFERRED EMBODIMENTS

Figure 1:
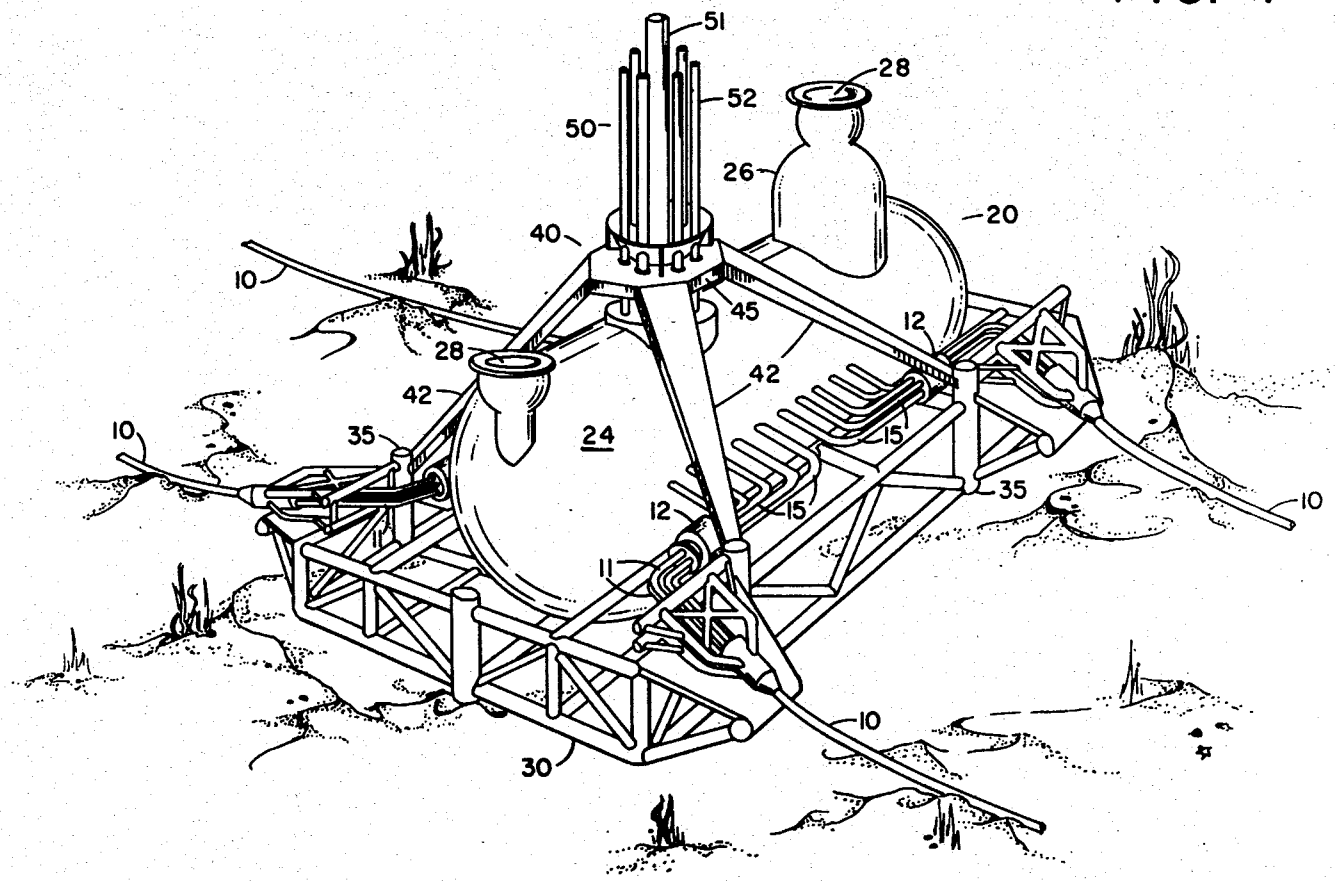
FIG. 1 is a perspective view of the improved subsea riser manifold system.
Figure 2B:
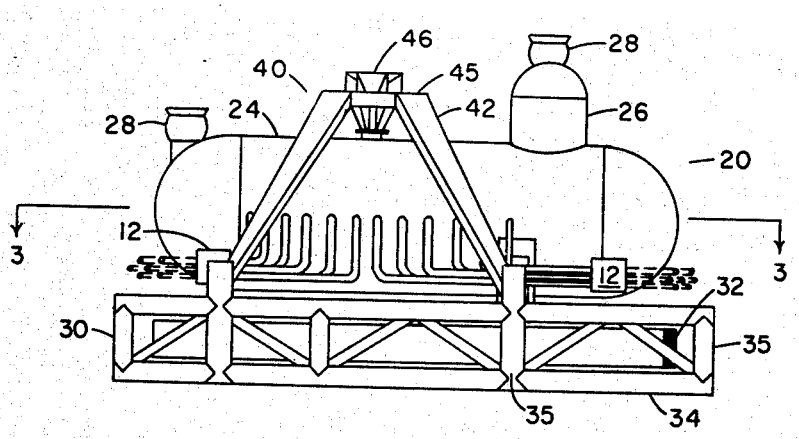
FIG. 2B is a plan view thereof.
Figure 2B:
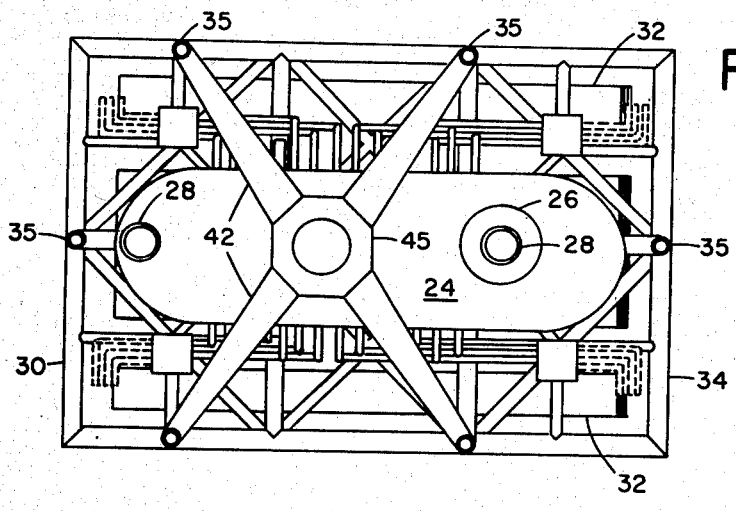
Figure 2C:
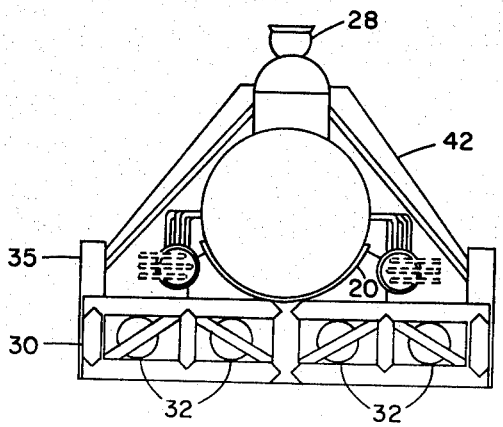
FIG. 2C is an end elevation view thereof.

The manifold system is shown in perspective view in FIG. 1, wherein a multiple flowlines 10 are operatively connected in fluid flow relationship to multiple wellheads or well clusters which have been completed a distance from the central hydrocarbon gathering point. Each of the flow lines 10 may comprise a bundle of individual conduits for carrying produced fluids, injection fluids, service lines, TFL lines and hydraulic lines. The flowlines are attached to the manifold chamber 20 at fixed positions provided for subsea connection after installation of the chamber 20, which is supported on the marine floor by base template 30, which includes a support structure and pile guides 35. A spanning structural member 40, shown here as a spider configuration with a pair of arms 42 on each side of the chamber hull 20, is attached to the pile guides 35 to support an upper platform portion 45. Production riser 50 is connected to horizontal platform 45 in load-transmitting relationship in order to direct the riser load forces to the piles without significant riser load being borne by the structurally-sensitive chamber hull, which may be required to withstand extreme hydrostatic pressure at depths of hundreds or thousands of meters below sea level. The indivdual conduits 11 which extend from flowlines 10 are connected to the manifold system through respective fluid connector elements 12, usually at the time of laying the flowline between remote wellhead locations and the manifold system. From the fluid connectors 12, fixed piping lengths 15 provide fluid paths to respective hull penetrators 22 mounted at spaced intervals along each side of the elongated manifold chamber hull 20.

The chamber hull is provided with a long horizontal central chamber portion 24, a control room 26 and access means 28 for transfer of operating/maintenancepersonnel from a submarine vessel (not shown). The chamber can be constructed integrally with the base and installed as a unit by piling and leveling one end and two side piles in triangular configuration.

FIS. 2A, 2B and 2C are side elevation, plan and end elevation views, respectively, of the manifold system and show certain features of the invention in greater detail. Template 30 may be provided with ballast tanks 32 for ease of handling during towing and installation of the structure. In general the base template is an open rectilinear welded metal structure with an outer tubular metal frame 34, cross-braced for strength and having a plurality of pile guides 35 disposed around the periphery of the frame.

Figure 3:
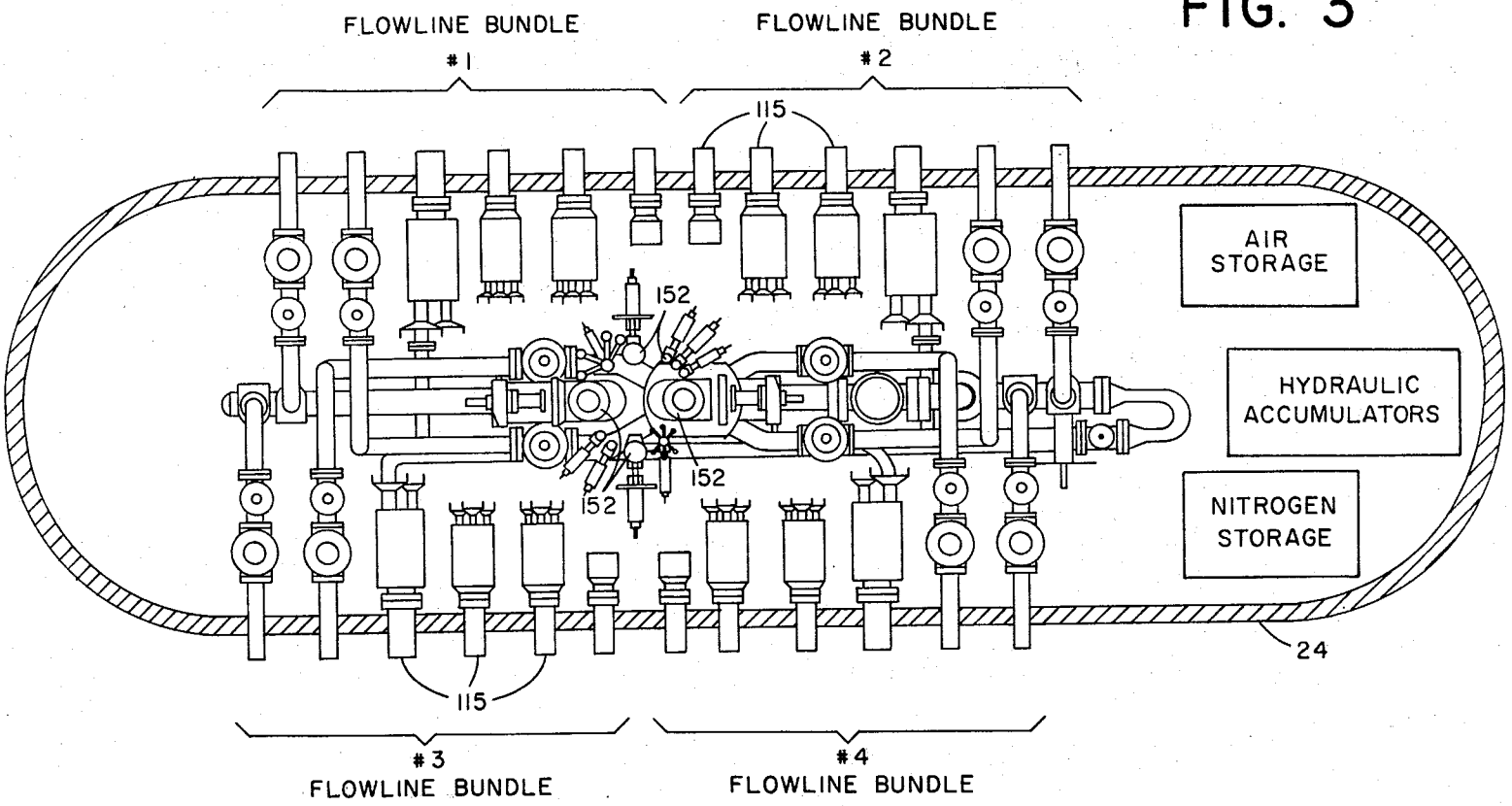
FIG. 3 is a cross-sectional plan view of the chamber hull showing internal fluid handling apparatus.

The internal fluid handling system of a typical SARM system, as shown in FIG. 3, provides for operatively connecting the individual conduits from flowlines at their terminations to the production riser piping. Various produced petroleum streams, gas streams, injection streams and hydraulic lines can be manifolded through their respective lines and valves individually according to their respective production schedules.

The hull 24, shown in horizontal cross-section encloses an atmospheric chamber in which is maintained an explosion-inhibiting inert atmosphere, such as nitrogen. The flow line conduits from each of four remote well connections are brought through the pressure-resistant hull via integrally-welded penetrators 115 arranged in spaced linear array for convenience of handling. Oil product lines and other conduits from each well can be manifolded to their respective production riser connections 152. Internal valve means permits sequencing or combining fluids according to the production schedules. Remotely-actuated and/or manual valve operations are employed, as desired. The life support system for the habitable portions of the SARM system may be connected to the surface by one or more conduits in the riser group for air, exhaust, communications, power, etc.

Figure 4:
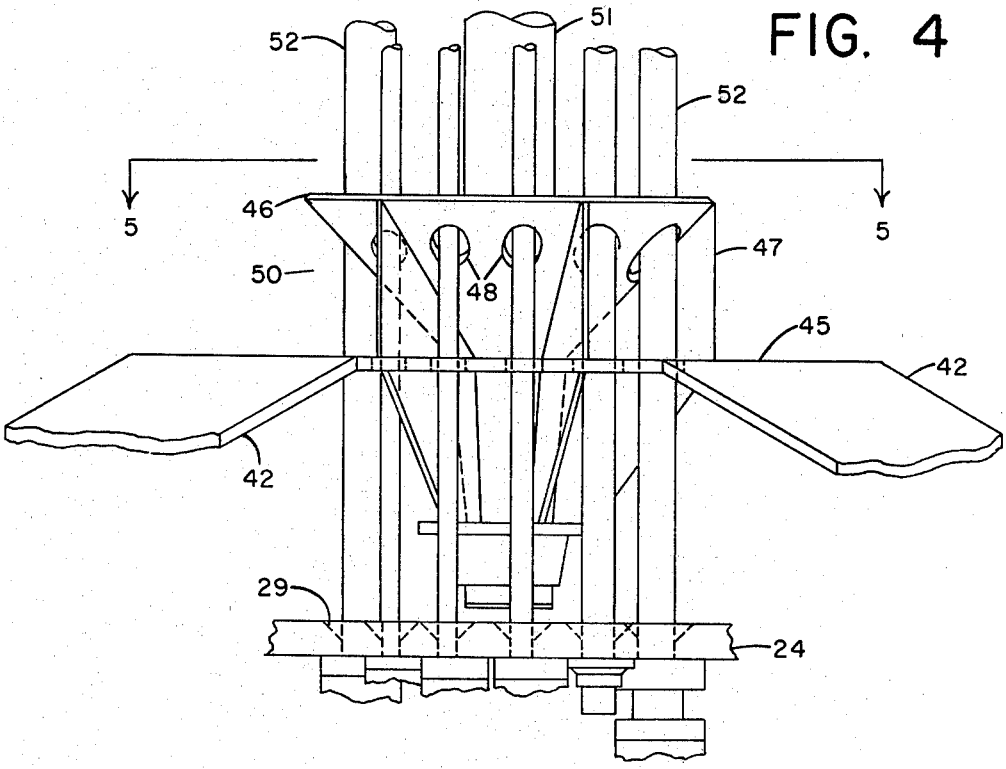
FIG. 4 is a detailed side view of a portion of the structural spanning member, showing connection of a production riser to the manifold system.
Figure 5:
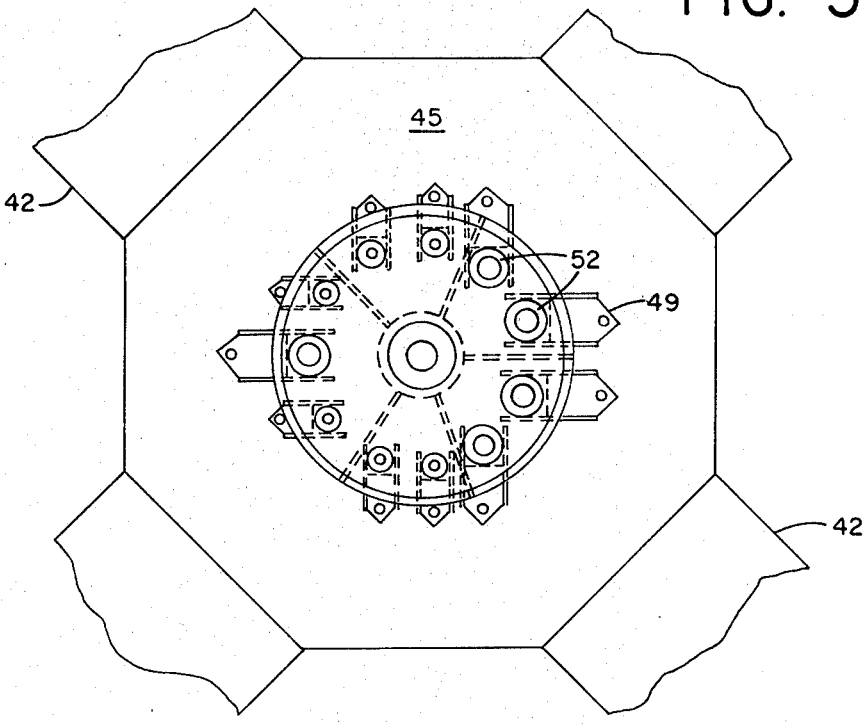
FIG. 5 is a plan view thereof, along lines 5—5 of FIG. 4.

The riser support structure or spanning member 40 is welded directly to four of the pile guides 35. In this way, the riser loading is directed primarily into the pile and influences the rest of the template only minimally. The open channel construction of the legs and the stiffened box like construction of the platform at the top, amply resists the riser stresses and minimizes deflections due to the upper riser movement. The upper platform 45 is located at predetermined distance away from the hull structure 24 to provide for any access that may be required to inspect and/or maintain flow riser connections. A central strength member 51 of the riser 50 connects to the riser support structure and not directly to the chamber hull. Therefore, the major load is borne by the base template 30 and not the chamber 20. The upper riser support structure platform also incorporates an entry funnel 46 for the lower section of the riser. Funnel 46 directs the strength member 51 to a locking device. The flow risers 52 proceed through this interfacing equipment and mate directly in fluid communication with the chamber 20. As shown in FIGS. 4 and 5, funnel 46 assists stabbing the central riser core 51 in to the riser support structure. Funnel 46 may be reinforced by a set of gussets 47 located between its surfaces and the support structure. Holes 48 through the funnel 46 allow the passage of the individual flowlines 52 and bundles. Small funnels 29 for the flowlines and bundles may be incorporated into the hull 24. Retractable stabbing pocket covers 49 may be used to protect the system prior to installation of the various riser components.

Figure 6:
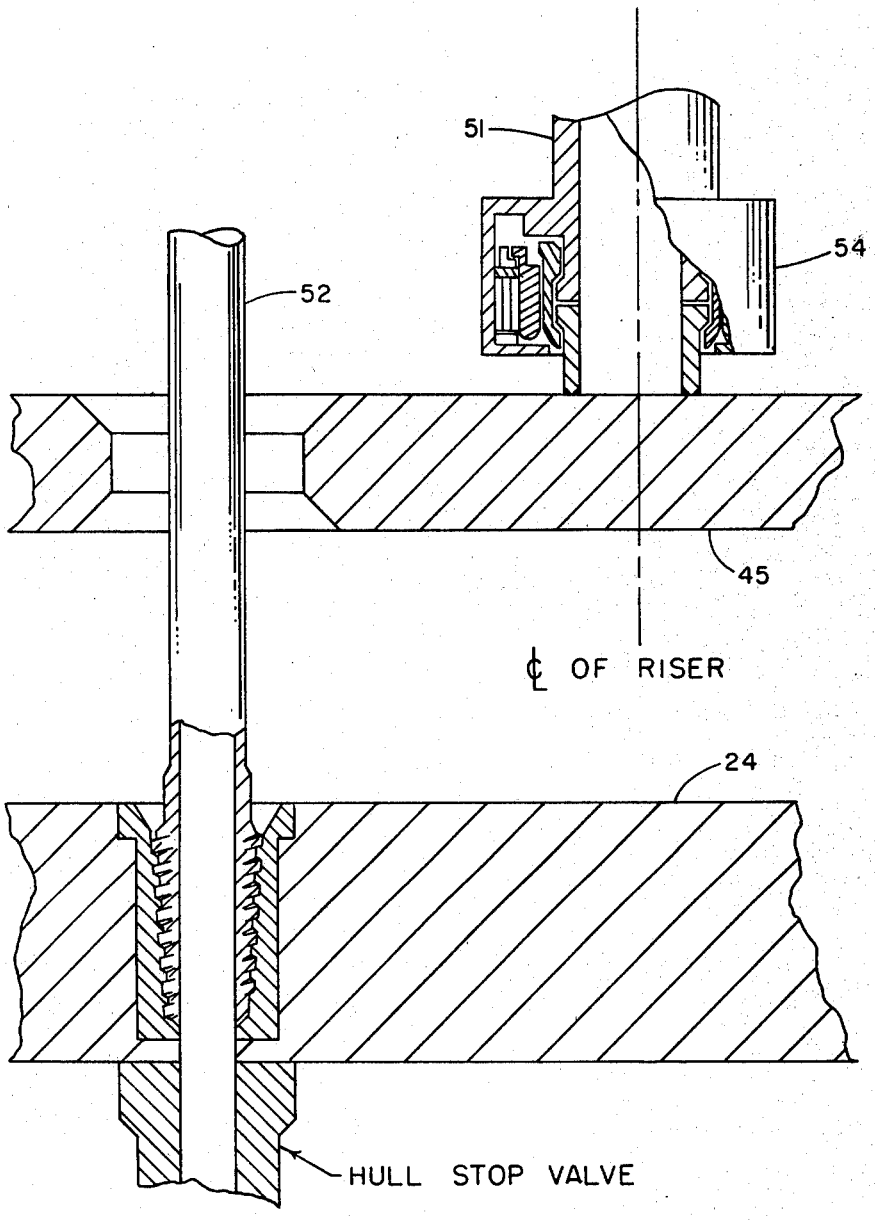
FIG. 6 is a detail cross-sectional view of a portion of the structural spanning member and chamber.

Following installation of the manifold system a preferred technique for attaching the production riser is to first provide a central structural core member 51, which may be the main load-transmitting member of the riser 50. This central member may or may not be a fluid conduit and for purposes of illustration is shown herein as a structural element only, connected mechanically to the spanning member platform 45, but not penetrating the hull chamber 24. Typical production riser components are disclosed in U.S. Pat. Nos. 4,182,584 (Panicker et al.) and 4,194,568 (Buresi et al.). Preferably the central core member 51 is locked to platform 45 with a positive hydraulically-actuated connector 54, as shown in FIG. 6. A buoyed riser system then can exert a pulling force upwardly on the riser. The other conduits 52 may then be lowered into position spaced apart from the central core member 51. Since conduits 52 can be supported from the riser buoy, relatively little force need be transmitted between conduits 52 and chamber hull 24, permitting the subsea manifold chamber to function as a reliable pressure-resistant vessel without the danger of overloading. Flowlines 52 may terminate in left-hand thread metal-to-metal seals. The bottom terminations shown in FIG. 6 are replaceable sockets located in the hull wall structure 24. Left-hand threads are chosen for this connection so that full torque capacity of a drill string being rotated in the right-hand direction is available for use in disconnecting the flowlines.

Figure 7:
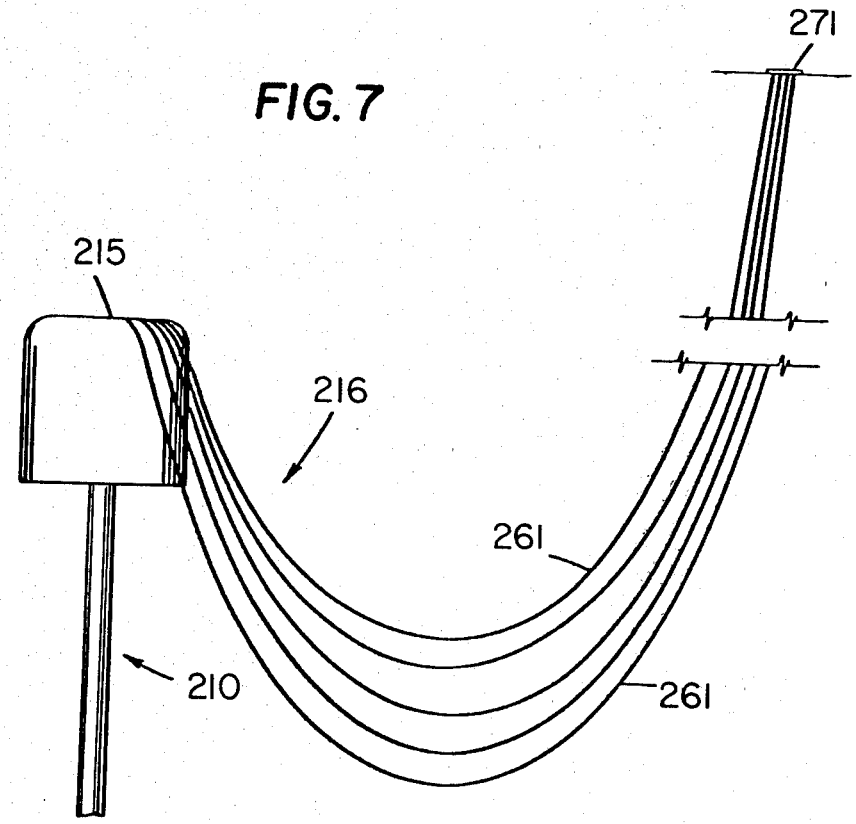
FIG. 7 is a perspective view of a buoy and flexible lines exiting from the top of rigid section of the riser and extending to the surface.

With reference to FIG. 7, there is shown a portion of a production riser disclosed in U.S. Pat. No. 4,182,584.

The riser is comprised of a lower rigid section 210 and an upper flexible section 216. The flexible 216 is comprised of one or more flexible conduits 261 which connect to respective one or more flow passages in rigid section 210. The flexible conduits 261 extend upward through and over the upper surface of a buoy 215 and then downward through catenary loops before extending upward to the surface of the water where they are affixed to the bottom of a mounting flange 271 on a floating facility. Buoy 215 maintains lower rigid section 210 in a vertical position under tension.

What is claimed is:

1. A subsea riser manifold system for handling marine well fluids from multiple subsea wells and transmitting the well fluids to a surface facility comprising:

a riser system including a buoy located below the surface of the water, a lower rigid section extending vertically downwardly from and maintained under tension by said buoy, and an upper flexible section between said buoy and the surface facility; said lower rigid section including a plurality of lower section flowlines supported by said buoy, and a strength member; said upper flexible section including a plurality of flexible flowlines, each connected to a respective one of said lower section flowlines;

a marine floor base template including a support structure and a plurality of pile guides connected to the template for fixing the template to the marine floor;

a sealed manifold chamber hull mounted on said support structure between said pile guides;

a structural spanning support member extending over said hull for receiving and supporting said strength member; said spanning member having an upper riser-receiving platform portion vertically spaced from said hull, and a plurality of spanning arms extending downwardly and outwardly from said platform portion, each of said spanning arms being connected to a respective one of said pile guides; and said hull comprising manifold means therein for operatively connecting the subsea wells through said spanning member to said lower section flowlines, and means for maintaining a low pressure atmosphere;

whereby the buoyed riser load is transmitted directly to the pile guides through said spanning member.

2. The system of claim 1 wherein said hull is a fluid-tight horizontal cylindrical pressure vessel.

3. The system of claim 2 wherein a pair of said spanning arms extend downwardly and outwardly from said platform portion on each of opposite sides of said pressure vessel.

4. The system of claim 1 wherein said spanning member includes a funnel structure for receiving said strength member.

5. The system of claim 1 wherein said flexible flowlines extend in a catenary loop between said buoy and said surface facility.

* * * * *